US005303651A

United States Patent [19]

Sugiyama et al.

[11] Patent Number: 5,303,651

[45] Date of Patent: Apr. 19, 1994

[54] PRINTING CYLINDER/ROLLER CLEANING APPARATUS FOR PRINTING PRESS

[75] Inventors: Hiroyuki Sugiyama; Toshihiko Ebina, both of Ibaraki, Japan

[73] Assignee: Komori Corporation, Japan

[21] Appl. No.: 8,196

[22] Filed: Jan. 25, 1993

[30] Foreign Application Priority Data

Jan. 27, 1992 [JP] Japan ..... 4-034051

[51] Int. Cl.[5] ..... B41F 35/00

[52] U.S. Cl. ..... 101/424; 101/423

[58] Field of Search ..... 101/424, 423, 425

[56] References Cited

U.S. PATENT DOCUMENTS 3,089,415 11/1961 Grembecki et al. ..... 101/425
3,763,778 10/1973 Sills et al. ..... 101/423
4,232,604 11/1980 Waizmann ..... 101/425
4,555,989 12/1985 Marass et al. ..... 101/424
4,747,348 5/1988 Jeschke et al. ..... 101/425
4,953,463 9/1990 Hara ..... 101/425

*Primary Examiner*—Edgar S. Burr
*Assistant Examiner*—Anthony H. Nguyen
*Attorney, Agent, or Firm*—Blakely, Sokoloff, Taylor & Zafman

[57] ABSTRACT

A printing cylinder/roller cleaning apparatus for a printing press includes a brush roller, a cleaning cloth, and a cam and a roller. The brush roller is pressed against the circumferential surface of a printing cylinder/roller having a gap in a part thereof to scrape contamination therefrom. The cleaning cloth is pressed against the circumferential surface of the printing cylinder/roller to wipe scraped contamination. The cam and roller position the brush roller in a radial direction of the printing cylinder/roller, thereby retreating the brush roller from the gap.

4 Claims, 2 Drawing Sheets

PRINTING CYLINDER/ROLLER CLEANING APPARATUS FOR PRINTING PRESS

BACKGROUND OF THE INVENTION

The present invention relates to a printing cylinder/-roller cleaning apparatus in various types of printing presses, which cleans the circumferential surface of a printing cylinder, e.g., a blanket cylinder, an impression cylinder, or a transfer cylinder, and the circumferential surface of a roller, e.g., a form roller or a vibrating roller.

Generally, in a printing press, when printing is continued for a certain period of time, residue, e.g., ink dust or paper dust is accumulated on the circumferential surface of the printing cylinder to soil the printing cylinder. Therefore, the printing cylinder must be cleaned every predetermined period of time. Conventionally, since the printing cylinder is manually cleaned, a long period of time and much labor are needed. In order to solve this problem, recently, there is proposed a method wherein a cleaning cloth is pressed against the circumferential surface of a rotating printing cylinder to wipe the residue, or a method wherein the residue is scraped by a brush roller.

However, according to the former method, since the circumferential surface of the printing cylinder is wiped only with the cleaning cloth, the paper dust is not removed well, and thus a long cleaning time is needed. According to the latter method, the brush roller falls in a gap formed in the axial direction of the printing cylinder. The cleanness is degraded in the vicinity of the gap due to the elastic reaction of the brush roller caused by the impact of falling. Also, the cleaning agent is scattered by the impact to drip in the gap. If this liquid drip is left, it may cause a printing error.

SUMMARY OF THE INVENTION

It is an object of the present invention to provide a printing cylinder/roller cleaning apparatus for a printing press, which completely removes paper dust contamination within a short period of time, thus improving the cleaning performance.

It is another object of the present invention to provide a printing cylinder/roller cleaning apparatus for a printing press, in which scattering and liquid drip of the cleaning agent are prevented.

In order to achieve the above objects, according to the present invention, there is provided a printing cylinder/roller cleaning apparatus for a printing press, comprising a brush roller, pressed against a circumferential surface of a printing cylinder/roller having a gap in a part thereof, for scraping contamination therefrom, a cleaning cloth, pressed against the circumferential surface of the printing cylinder/roller, for wiping scraped contamination, and positioning members for positioning the brush roller in a radial direction of the printing cylinder/roller, thereby retreating the brush roller from the gap.

DESCRIPTION OF THE PREFERRED EMBODIMENT

Figure 1:
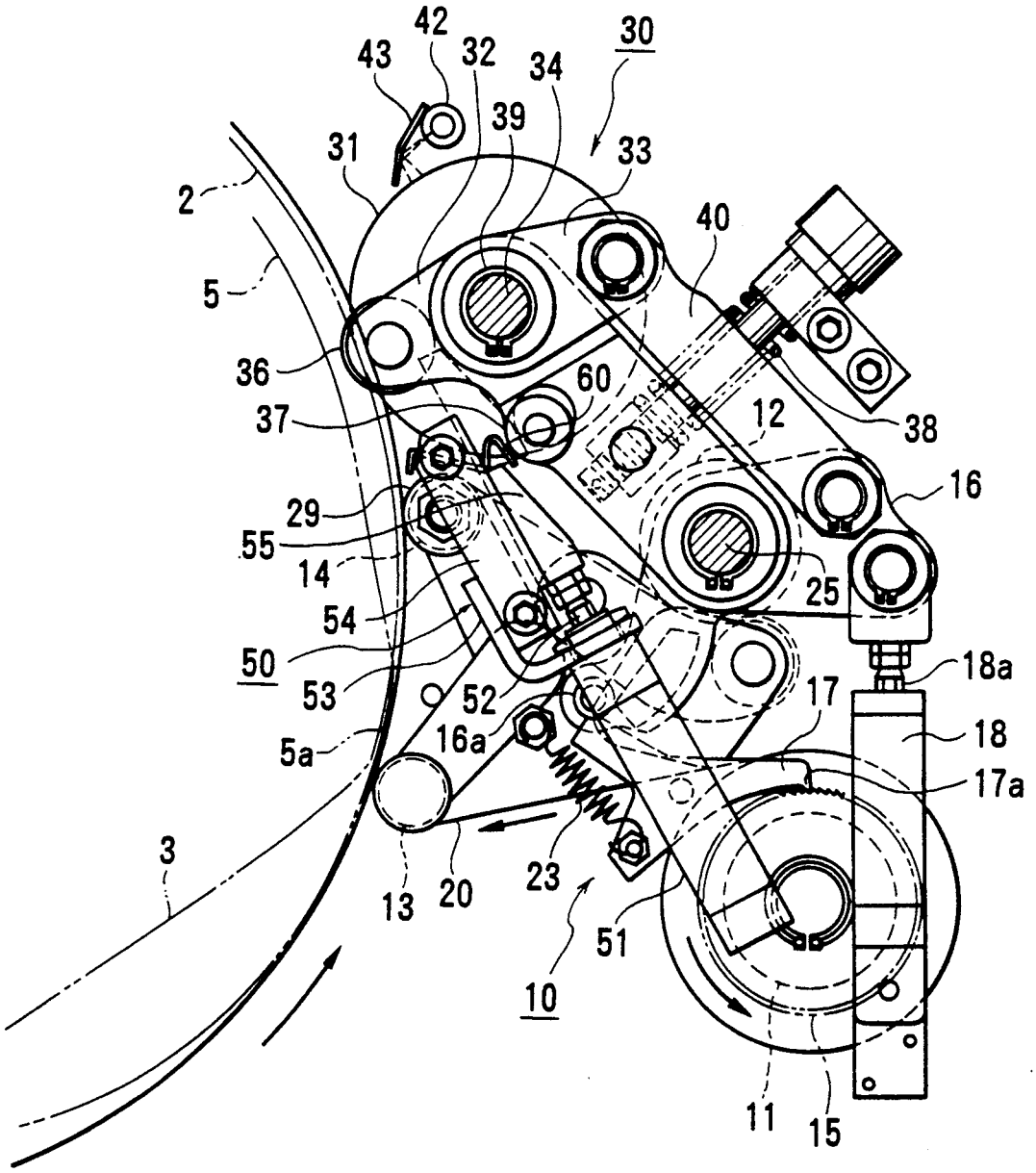
FIG. 1 is a side view showing a printing cylinder/-roller cleaning apparatus for a printing press according to an embodiment of the present invention.
Figure 2:
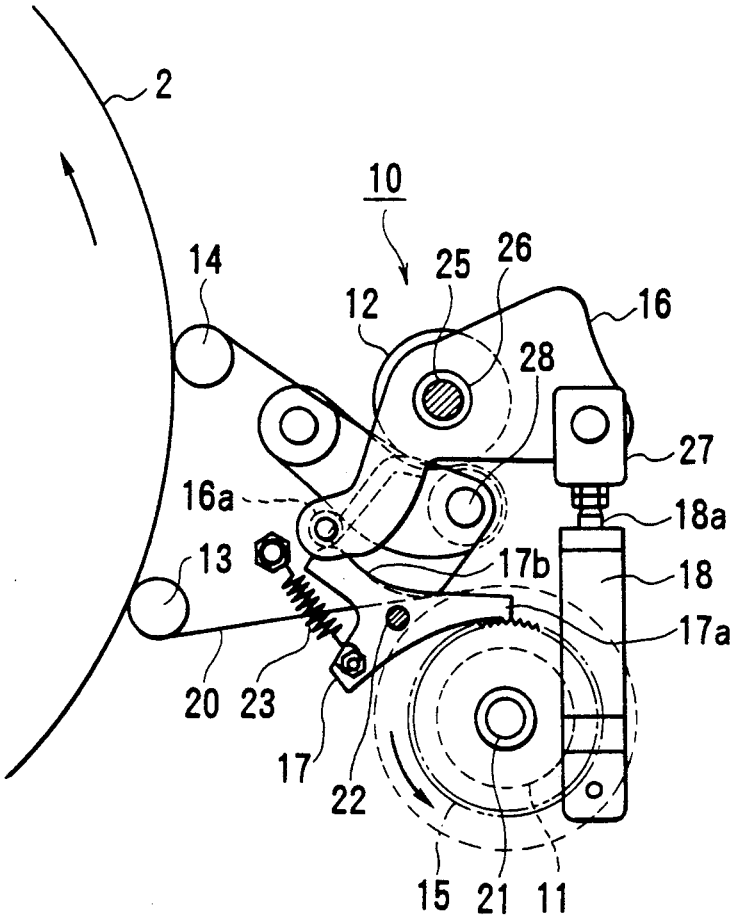
FIG. 2 is a side view of a main part of the printing cylinder/roller cleaning apparatus for a printing press according to the embodiment of the present invention.
Figure 3:
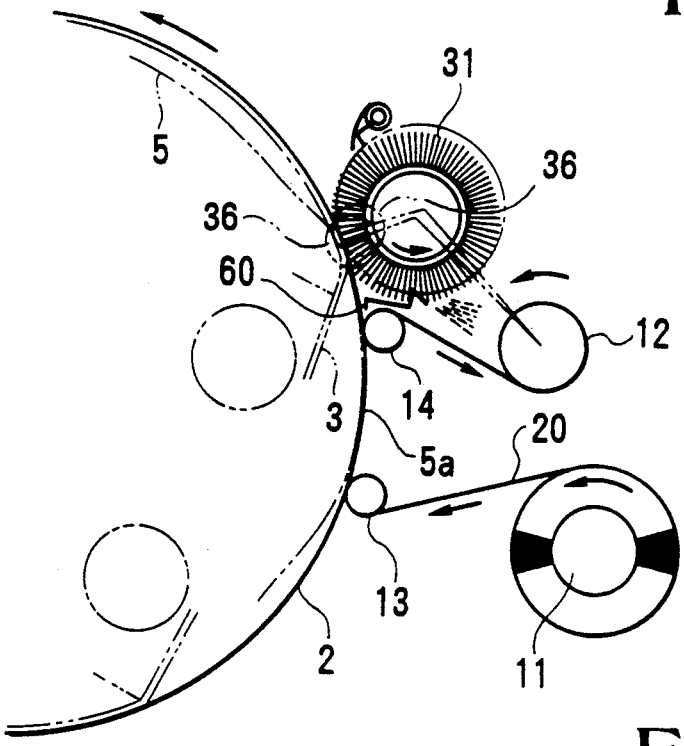
FIG. 3 is a view for explaining the operation of the printing cylinder/roller cleaning apparatus for a printing press shown in FIGS. 1 and 2.

A preferred embodiment of the present invention will be described with reference to the accompanying drawings. FIG. 1 shows a printing cylinder cleaning apparatus for a printing press according to an embodiment of the present invention, FIG. 2 shows the main part thereof, and FIG. 3 explains the cleaning operation. Referring to FIGS. 1 to 3, reference numeral 2 denotes a blanket cylinder pressed against an impression cylinder (not shown). A gap 3 for housing grippers (not shown) for gripping and conveying printing paper is formed in part of the circumferential surface of the blanket cylinder 2. A cam 5 having a cam surface along the circumferential surface of the blanket cylinder 2 is provided on a side surface of the blanket cylinder 2. A projection portion 5*a* having almost the same height as that of the circumferential surface of the blanket cylinder 2 is formed on the cam 5 at a position corresponding to the gap 3.

Reference numeral 10 denotes a cleaning cloth take-up mechanism. As shown in detail in FIG. 2, the cleaning cloth take-up mechanism 10 schematically comprises a supply shaft 11 for supplying a belt-like cleaning cloth 20, a take-up shaft 12 for taking up the cleaning cloth 20, a pair of guide rollers 13 and 14, a ratchet wheel 15 pivotally coaxially mounted on the supply shaft 11, a swing lever 16 swingably coaxially mounted on a shaft 25 of the take-up shaft 12, a lock lever 17 swingably supported on a shaft 22, and an air cylinder 18.

The supply shaft 11 is connected to the ratchet wheel 15 through a one-way clutch 21 whose rotation in a direction to supply the cleaning cloth 20 to the take-up shaft 12 is prohibited. A ratchet 17*a* is formed on one end of the lock lever 17, and a cam surface 17*b* is formed on the upper end surface of the lock lever 17. The lock lever 17 is normally swung by a spring 23 clockwise in FIG. 1, and the ratchet 17*a* is engaged with the ratchet wheel 15. The take-up shaft 12 is connected to the swing lever 16 through a one-way clutch 26 which is rotatable only in a direction to take up the cleaning cloth 20 on the take-up shaft 12.

A guide roller 16*a* slidable on the cam surface 17*b* of the lock lever 17 is provided on one end of the swing lever 16. The air cylinder 18 is provided with a reciprocal rod 18*a*. The rod 18*a* and the other end of the swing lever 16 are coupled to each other through a connection block 27. Reference numeral 28 denotes a stopper pin for regulating the counterclockwise swing movement of the swing lever 16 upon being abutted against the swing lever 16. Reference numeral 29 denotes a guide roller pivotally coaxially supported on the guide roller 14. The guide roller 29 has a diameter slightly larger than that of the guide roller 14 and is pressed against the bearers of the blanket cylinder 2. The cleaning cloth 20 supplied from the supply shaft 11 is extended through the pair of guide rollers 13 and 14 and taken up by the take-up shaft 12.

Reference numeral 30 denotes a brush roller mechanism, and schematically comprises an L-shaped lever 32, a pivot lever 33, a spring 38, and a spray nozzle 42.

The L-shaped lever 32 has one end pivotally supporting a shaft 34 of the brush roller 31. The pivot lever 33 is connected to the brush roller 31 through a one-way clutch 39. The spring 38 biases the L-shaped lever 32. The spray nozzle 42 sprays a cleaning agent. The brush roller 31 is disposed downstream the guide roller 14 and axially rotatably supported by the shaft 34. The L-shaped lever 32 for pivotally supporting the shaft 34 is swingably supported by the shaft 25 on its other end, and is rotated by the spring 38 counterclockwise in FIG. 1. Hence, the brush roller 7 is biased toward the blanket cylinder 2.

Two rollers 36 and 37 are rotatably supported at the free end of the L-shaped lever 32. The peripheral end of one roller 36 serving as the positioning means to operate with the cam 5 projects from the peripheral end of the brush roller 31 in the circumferential direction of the blanket cylinder 2. Also, the roller 36 is connected so as to transmit rotation from the pivot lever 33 to the brush roller 31 only counterclockwise in FIG. 1 through the one-way clutch 39. One end of the pivot lever 33 is coupled to one end of a link 40, and the other end of the link 40 is coupled to the swing lever 16. The cleaning agent sprayed by the spray nozzle 42 is deflected by the reflecting plate 43 and diffused onto the brush roller 31.

Reference numeral 50 denotes a driving means comprising an air cylinder 51 having a reciprocal rod 52, a bracket 53 for fixing the air cylinder 51, a guide 54 fixed to the bracket 53, and a cam 55 vertically guided by the guide 54 and having a lower end portion coupled to the distal end portion of the rod 52. The other roller 37 of the L-shaped lever 32 contacts the cam 55. The L-shaped lever 32 is moved close to and away from the blanket cylinder 1 by the cam 55 which is vertically moved as the actuator 52 is moved forward and backward. Reference numeral 60 denotes a contamination scraping member 50, fixed to a frame (not shown) and pressed against the outer circumferential portion of the brush roller 31, for removing contamination on the brush roller 31.

The cleaning operation of the blanket cylinder 2 will be described.

The cleaning liquid from the spray nozzle 42 is diffused by the reflecting plate 43 and sprayed toward the brush roller 31. The air cylinder 51 of the driving means 50 is actuated to retract the rod 52 in the air cylinder 51 and to move the cam 55 downward along the guide 54. Then, the roller 37 slides on the cam 55, the L-shaped lever 32 is swung by the biasing force of the compression spring 38 about the shaft 25 counterclockwise in FIG. 1, and only the brush roller 31 moves close to the circumferential surface of the blanket cylinder 2. At this time, the pair of guide rollers 13 and 14 are away from the circumferential surface of the blanket cylinder 2.

The air cylinder 51 of the driving means 50 is actuated, and a driving means (not shown) is actuated simultaneously or with a small delay, so that the brush roller 31 and the pair of guide rollers 13 and 14 are moved close to the circumferential surface of the blanket cylinder 2. By this time, the brush roller 31 has already moved close to the circumferential surface of the blanket cylinder 2. Hence, the brush roller 31 starts to be pressed against the circumferential surface of the blanket cylinder 2 and gradually increases its contact width until the roller 36 contacts the cam 5. As the blanket cylinder 2 is rotated, contamination, e.g., the ink dust and paper dust, on the circumferential surface of the blanket cylinder 2 is scraped before the cleaning cloth 20 is pressed against the circumferential surface of the blanket cylinder 2. When the guide roller 29 is abutted against the circumferential surface of the blanket cylinder 2 and the cleaning cloth 20 is pressed against the blanket cylinder 2, the ink tack on the circumferential surface of the blanket cylinder 1 is already removed. Therefore, the cleaning cloth will not be damaged by the ink tack, and cleaning can be effectively performed.

In this state, the roller 36 is also abutted against the cam 5 to scrape the ink dust and paper dust with the brush roller 31 for several seconds, and remaining contamination is wiped together with the cleaning liquid by the cleaning cloth 20, thereby performing the cleaning operation. This cleaning operation is performed by actuating the air cylinder 18 to move the rod 18*a* forward. When the rod 18*a* is operated, the link 40 is moved upward to pivot the pivot lever 33 counterclockwise through a predetermined angle. The brush roller 31 is caused to slide on the circumferential surface of the blanket cylinder by its pivot movement. When the air cylinder 18 is intermittently actuated, the brush roller 31 is intermittently rotated to scrape contamination on the blanket cylinder 2.

As the pivot lever 33 is rotated, the swing lever 16 swings counterclockwise in an interlocked manner with the operation of the rod 18*a*, to rotate the take-up shaft 12 counterclockwise, i.e., in a direction to take up the cleaning cloth 20 by a predetermined length through the one-way clutch 26. At this time, when the guide roller 16*a* of the swing lever 16 slides on the cam surface 17*b*, the lock lever 17 is swung counterclockwise against the spring 23, so that engagement between the ratchet wheel 15 and the ratchet 17*a* is released. Hence, the take-up operation by the take-up shaft 12 is enabled. The take-up operation of the cleaning cloth 20 is intermittently performed in synchronism with rotation of the brush roller 31 described above, thereby wiping contamination on the blanket cylinder 2.

During rotation of the 31 and the brush roller 31 and the take-up operation of the cleaning cloth 20, the blanket cylinder 2 continues to be rotated counterclockwise in FIG. 1, and the brush roller 31 is biased toward the blanket cylinder 2. Therefore, the radial positional relationship between the brush roller 31 and the blanket cylinder 2 is determined by the roller 36 that slides on the cam 5 and held. As shown in FIG. 3, when the blanket cylinder 2 is rotated to bring the gap 3 to a position to contact the brush roller 31, the roller 36 slides on the projection portion 5*a* of the cam 5 and escapes the brush roller 31 from the gap 3. Hence, the brush roller 31 will not fall in the gap 3, cleanness in the vicinity of the gap 3 will not be degraded, or the cleaning agent will not scatter, and cleaning by the brush roller 31 is smoothly performed.

When the cleaning operation is ended, the air cylinder 51 of the driving means 50 is actuated to move the rod 52 forward from the air cylinder 51, so that the L-shaped lever 32 is swung by the cam 55 clockwise about the shaft 25, thereby moving only the brush roller 31 away from the blanket cylinder 2. In this state, only the cleaning cloth 20 is pressed against the circumferential surface of the blanket cylinder 2 for several seconds to wipe the circumferential surface of the blanket cylinder 2. Thereafter, the driving means (not shown) is actuated to move the cleaning cloth 20 and the brush roller 31 away from the blanket cylinder 2.

In this embodiment, the sliding operation of the cam 5 and the roller 36 serves as the means for positioning the brush roller 31 in the radial direction of the blanket cylinder 2. However, the present invention not limited to this. The brush roller 31 can be escaped by electrically detecting the position opposing the gap 3 of the blanket cylinder 2. Various design changes can be made. Also, in this embodiment, the blanket cylinder 2 is the cylinder to be cleaned with the cleaning cloth 20. However, the present invention is not limited to this, and can naturally be applied to any other printing cylinder or a rotary roller that needs positioning.

As has been described above, according to the present invention, the brush roller is escaped from the gap of the printing cylinder/roller by the positioning member so that it will not fall in the gap. Therefore, the cleanness will not be degraded in the vicinity of the gap or the cleaning agent will not scatter, so that cleaning by using the brush roller can be smoothly performed. Furthermore, since the brush roller mechanism and the cleaning cloth take-up mechanism are coupled to each other through the link member, the number of driving components is decreased to reduce the size of the entire apparatus. In addition, rotation of the brush roller and taking-up of the cleaning cloth can be interlocked by a simple mechanism, thus providing an apparatus that can perform a smooth operation and is relatively free from an error.

What is claimed is:

1. A cleaning apparatus for cleaning a printing cylinder/roller of a printing press, comprising:

a brush roller, intermittently rotated and pressed against a circumferential surface of said printing cylinder/roller having a gap in a part thereof, for scraping contamination therefrom;

a cleaning cloth, pressed against said circumferential surface of said printing cylinder/roller, for wiping scraped contamination;

said cleaning cloth being positioned to contact said cylinder/roller on the upstream side of the cylinder/roller relative to said brush roller;

positioning members for positioning said brush roller in a radial direction relative to said printing cylinder/roller, said positioning means moving said brush roller away from the gap;

a mechanism for rotating said brush roller toward and away from said printing cylinder/roller;

a cleaning cloth take-up mechanism for taking up said cleaning cloth;

a link member for coupling said mechanism for rotating with said cleaning cloth take-up mechanism so that rotation of said brush roller and taking-up of said cleaning cloth are performed substantially simultaneously; and driving means for commonly driving both the cleaning cloth take-up mechanism and the brush roller mechanism through the link member.

2. An apparatus according to claim 1, wherein said positioning members comprise a cam formed on a side surface of said printing cylinder/roller and having a projection portion having almost the same height as that of said circumferential surface of said printing cylinder/roller at a position to correspond to the gap, and a slidable member, biased toward said circumferential surface of said printing cylinder/roller together with said brush roller, for sliding on a cam surface of said cam.

3. An apparatus according to claim 2, wherein said slidable member comprises a roller which is rotatably supported on a side of one end of a lever having said one end axially supporting said brush roller and the other end swingably supported, and which has a peripheral surface projecting from a peripheral surface of said brush roller toward said circumferential surface of said printing cylinder/roller.

4. An apparatus according to claim 1, wherein the brush roller is disposed above the cleaning cloth so that, after the brush roller scraps off contamination from the surface of the cylinder/roller, the contamination is removed by the cleaning cloth.

* * * * *